US005752616A

United States Patent [19]

Watkinson

[11] Patent Number: 5,752,616

[45] Date of Patent: May 19, 1998

[54] STORAGE VESSEL

[75] Inventor: Charles John Watkinson, Goole, United Kingdom

[73] Assignee: Prime Safe Limited, Leeds, United Kingdom

[21] Appl. No.: 532,583

[22] Filed: Sep. 28, 1995

[30] Foreign Application Priority Data

Mar. 30, 1993 [GB] United Kingdom ..... 9306559

[51] Int. Cl.[6] ..... B65D 90/04

[52] U.S. Cl. ..... 220/453; 220/460; 220/461

[58] Field of Search ..... 220/421, 422, 220/453, 460, 461, 457

[56] References Cited

U.S. PATENT DOCUMENTS

| | | | |
|---|---|---|---|
| 4,993,581 | 2/1991 | Mitchell | 220/453 |
| 5,000,342 | 3/1991 | Sharp | 220/454 |
| 5,054,645 | 10/1991 | Sharp | 220/445 |
| 5,072,609 | 12/1991 | Sharp | 73/49.2 |
| 5,167,352 | 12/1992 | Robbins | 220/402 |

*Primary Examiner*—Joseph M. Moy
*Attorney, Agent, or Firm*—Madson & Metcalf

[57] ABSTRACT

A method of applying a laminate (4, 5, 6) to one side of a wall of a storage vessel (1) and which comprises: securing a first substantially impermeable layer (4) to said one side of the wall; securing an intermediate liquid pervious layer (5) to the exposed side of said first layer (4); and, securing a second substantially impermeable layer (6) to the exposed side of the intermediate layer (5) so as to define a fluid receiving space between the first and second layers (4, 6) in which a monitoring fluid can be received to permit monitoring of the sealing integrity of the storage vessel. The intermediate layer (5) includes a liquid or fluid pervious layer (5*a*) e.g. of open celled foam, which is bonded to the first impermeable layer (4) and a semi-impermeable layer (5*b*) e.g. of paper which faces and which becomes bonded to the second impermeable layer (6) upon at least partial impregnation by the material of the layer (6). The layer (5*b*), therefore performs a dual function, in that it assists in uniting the component layers of the laminate, and also prevents the material making-up the second impermeable layer (6) from impregnated or clogging-up the pores of the pervious layer (5*a*).

15 Claims, 5 Drawing Sheets

STORAGE VESSEL

This invention relates to a storage vessel and a method of forming a storage vessel of the type used to contain and store fluids. The invention is particularly, though not exclusively, suitable for use with storage vessels which are located underground or are prone to degradation through corrosion, for example, underground fuel tanks for filling stations.

Many of today's existing filling stations were built during the 1950's and 1960's. Filling station buildings may have been upgraded since then, but the original underground tanks used to store the fuel have not been replaced. These tanks are generally cylindrical and composed of steel of approximately 6 mm in thickness. The tanks are located underground and surrounded by concrete walls and ballast, for example, and gravel to support the tank. The tanks were designed to have a life of about 30 years. However, it has been found that existing tanks have suffered corrosive damage, in particular, pitting corrosion. In extreme cases, corrosion can lead to penetration of the tank material giving rise to locations through which contained fluids can escape or leak. This can be hazardous, especially if the leaking fluid is flammable or poisonous and this clearly poses a threat to the surrounding environment.

Corrosion of steel tanks takes place by localised electrochemical reactions on the surface of the steel which may be caused, for example, by soil conductivity i.e. how acidic or alkaline the soil is, or by chemicals dissolved in water or moisture present in the ground. Pitting corrosion can be particularly problematic as the corroded site tends to be quite small and, chemical and electrochemical reactions occurring in the "pit", tend to produce high concentrations of corrosive ions and a high current density which accelerate corrosion processes. Steel is also susceptible to stress corrosion cracking where the presence of corrosive agents at a crack can produce rapid propagation of the crack.

One known solution is to replace the steel tanks with a double skinned GRP (Glass Reinforced Plastic) tank. A mesh membrane is used to create a void space between the inner and outer skins and this is filled with a slightly pressured fluid, for example, water. The level of fluid in the tank is monitored by a gauge. In this way a leakage of the-pressured fluid caused by a perforation in either the outer skin or the inner skin can be recorded by the gauge immediately. However, present techniques of forming a double skinned GRP tank with suitable mechanical properties which can withstand the forces and loads generated by the weight of contained fluid are not satisfactory. In particular, relatively thick skins are required to give the GRP tank sufficient strength and rigidity. It is believed that such GRP tanks are prone to creep and stress cracking when subjected to the magnitude of loads that may be generated by the weight of contained fluid. Furthermore, the pressurised fluid acts to separate the skins of the GRP tank and causes further weakening of the tank.

According to one aspect of the invention there is provided a storage vessel for containing a fluid, in which a wall of the vessel has a laminate secured to one side thereof, and said laminate comprising:

- a first substantially impermeable layer secured to said one side of the wall;
- a second substantially impermeable layer; and,
- an intermediate liquid pervious layer secured on one side to said first layer and on an opposite side to said second layer, said intermediate layer serving to define a fluid receiving space between the first and second layers in which a monitoring fluid can be received to permit monitoring of the sealing integrity of the storage vessel.

Thus, in the event of any leakage path being generated between the interior of the vessel and the surrounding environment (in either direction), this leakage path will allow transfer of liquids (or fluids) to or from the space holding the monitoring fluid in use, and which can be readily detected by any suitable monitoring equipment e.g. a level depth gauge in he case of a monitoring liquid, to give an early warning of any potentially hazardous leakage arising.

The storage vessel may be a liquid-storage vessel which may be located, or intended for location under ground, in which case the transfer of fluids may be the liquid-contents of the vessel e.g. petroleum to the surrounding sub-soil, or leakage of water from the surrounding water table back into the vessel, either of which is unacceptable, and potentially hazardous.

The application of the laminate to the wall of the storage vessel may take place in situ, and which will be particularly suitable for refurbishment of an existing installation of storage vessel e.g. underground storage tank, or may take place during initial fabrication of a storage vessel.

Preferably, the wall of the storage vessel to which the lamination is applied is a complete liquid confining wall of the vessel e.g. a cylindrical wall and two circular end walls of a circular cross section tank, or a bottom wall and at least four upstanding side walls (and preferably also a top wall) of a rectangular tank.

The side of the wall to which the lamination is applied may be the inner side, or the outer side as required. However, in the case of an in situ tank, it will of course be more convenient to apply the lamination to the inner side.

According to a further aspect of the invention there is provided a method of applying a laminate to one side of a wall of a storage vessel and which comprises:

- securing a first substantially impermeable layer to said one side of the wall;
- securing an intermediate liquid pervious layer to the exposed side of said first layer; and
- securing a second substantially impermeable layer to the exposed side of the intermediate layer so as to define a fluid receiving space between the first and second layers in which a monitoring fluid can be received to permit monitoring of the sealing integrity of the storage vessel.

The wall of the storage vessel to which the laminate is secured may be a metal wall e.g. fabricated steel, although other materials suitable to the fluid contents to be held, and also to the environment in which the vessel is to be located. The wall may be, for example, made of moulded plastics material, and more preferably GRP.

The invention therefore enables a storage vessel to be provided having the advantage of composite construction with enhanced mechanical properties, and particularly increased strength and rigidity. Known storage vessels with a double skin construction must have thicker walls to be able to withstand the pressures generated by the fluid contained within the vessel.

The invention further provides, in at least some aspects, a composite storage vessel having an interstitial space for leak monitoring; and in the case of a metal walled storage vessel a construction of resinous composite storage vessel within an existing metal framework.

When, as in one preferred embodiment, the storage vessel is composed of a plastics material, and more preferably GRP, this has the advantage of not being as susceptible to corrosion as a storage vessel composed of a steel or steel alloy.

The intermediate liquid pervious layer may take the form of a membrane, and which is formed from any suitable permeable material. It may then be filled by any suitable monitoring fluid to facilitate monitoring of the vessel for any leaks. A perforation or crack in either the inner skin or the outer skin of the vessel will result in a change of level of the fluid contained within the permeable membrane, with the level increasing or decreasing depending upon the circumstances e.g. leakage of the vessel contents into the liquid-holding space defined by the membrane may result in increase in the level of the liquid being monitored, whereas outward leakage through the outer skin of the monitoring liquid (within the liquid-holding space) to the surrounding sub-soil would result in a fall in the level of the monitoring liquid.

Preferably, the permeable material is an open cell foam. Foam takes up fluid easily; however, other permeable materials may also be used, for example, felt, screed or cloth.

The membrane may be formed from a layer of solid impermeable spheres with spaces defined between the spheres through which a fluid may be accommodated. On forming a layer of solid spheres, spaces are defined between their points of contact. This construction has the advantage that the spheres are solid and provide a more rigid overall vessel construction. In an alternative construction the membrane may be formed from a layer of fibres or fibrils extending between the outer and inner skins of the vessel. (One of the skins of the vessel will usually be formed by the wall of the vessel and the first layer of substantially impermeable material secured thereto, and the other of the skins will be formed by the second layer of substantially impermeable material).

Preferably, the permeable membrane has an impermeable layer at the interface between the membrane and the inner skin. The impermeable layer may be impregnated with a resin so as to provide a strong bond between the inner skin and the membrane.

In a particularly preferred arrangement, the membrane has a plurality of perforations extending therethrough, and the application of the second layer of substantially impermeable material to the intermediate layer results in some of the material of the second layer passing through the perforations in the intermediate layer in order to join together the inner and outer skins of the vessel.

The material passing through the perforations therefore forms a bridging means, and which preferably is composed of resin used in the formation of a GRP coating.

According to a third aspect of the invention there is provided a method of forming a storage vessel which comprises the steps of forming a first vessel skin of a plastics material on a rotating former, allowing the first skin to cure, applying a layer of perforated membrane to the first skin, and forming a second skin of a plastics material on the membrane with plastics material extending through the membrane perforations to form bridges between the first and second skins. Using this method it is possible to manufacture a double skin storage vessel with enhanced mechanical properties. Known double skinned storage vessels have thicker skins for similar mechanical properties. This construction of storage vessel helps to reduce creep which can lead to cracks in the vessel.

Preferably in the third aspect of the invention, the membrane is adhesively bonded to the first skin. This prevents the membrane from separating and becoming detached from the first skin as it is applied. Detached regions of membrane may be sites of weakness in the construction of the vessel.

The permeable membrane may have a semi-impermeable layer which allows impregnation of resin from the plastics material of the second skin as it is applied, but prevents the second skin from completely blocking the pores of the permeable membrane. In this way the membrane can still accept a fluid so that the vessel may be monitored for leaks. Furthermore, the impregnation of the semi-impermeable layer by resin enhances the overall strength of the storage vessel.

The first skin may be formed by applying a first layer of flake glass reinforced plastic followed by a second layer of GRP composite which may include chopped strand. The second layer has good crack resistance.

In a fourth aspect of the invention there is provided a method of refurbishing a storage vessel in situ which comprises the steps of: applying a first layer of plastics material to form a first skin bonded to the inner surface of the storage vessel; allowing the first skin to cure; applying a layer of perforated membrane to the first skin and forming an inner second skin of a plastics material on the membrane with plastics material extending through the membrane perforations to form bridges between the first and second skins. This method of refurbishing a storage vessel has distinct advantage that the existing storage vessel does not have to be removed or replaced. In the case of storage vessels of the type used in petrol filling stations this can be extremely advantageous. The storage vessels at filling stations are usually located under the forecourt and removal or replacement of these vessels would mean that the filling station would have to be closed and the site rebuilt. This would involve very high costs and also the loss of customers during the dismantling and rebuilding of the site. A further advantage is that existing storage vessels, which are usually steel, can provide additional strength and rigidity to the skins applied to the wall of the vessel.

Preferably, the skins of the storage vessel are composed of GRP (Glass Reinforced Plastic). GRP is less susceptible to corrosion and is the preferred material for refurbishing existing storage vessels.

Generally, the membrane is permeable. This allows a fluid to be introduced into the permeable membrane and facilitates a monitoring of the storage vessel for any leakages. The membrane may be composed of an open cell foam. Although foam is the preferred permeable material other permeable materials may be effectively used. Examples of other permeable materials include felt, screed or cloth.

The membrane may also be formed from a layer of solid impermeable spheres with spaces defined between the spheres in which a fluid may be accommodated. On forming a layer of solid spheres spaces are defined between their points of contact. This construction has the advantage that the spheres are solid and provide a more rigid overall vessel construction. The spheres are preferably coated in an adhesive such that the spheres adhere to each other and to the intermediate skin as they are applied. In an alternative construction the membrane may be formed from a layer of fibres or fibrils extending between the intermediate and inner skins of the vessel.

The solid spheres may have a diameter of less than about 6 mm, more preferably less than about 3 mm, an example of a suitable diameter of sphere would be about 2 mm.

Preferably, the membrane is adhesively bonded to the first skin. This prevents the membrane from separating and becoming detached from the skin. Applying the membrane on the overhead surface with the storage vessel may be difficult without an adhesive. Detached regions of membrane may be sites of weakness in the construction of the vessel.

The permeable membrane may have a semi-impermeable layer which allows impregnation of resin from the plastics material of the second skin as it is applied, but prevents the skin from completely blocking the pores of the permeable membrane. In this way the membrane can still accept a fluid so that the vessel may be monitored for leaks. Furthermore, the impregnation of the semi-impermeable layer by resin enhances the overall strength of the storage vessel.

Preferably, the semi-impermeable layer is paper which is bonded to the permeable material. Paper has the surprising advantage that it absorbs resin to form a good bond, but does not absorb so much resin that the permeable material becomes blocked.

The first skin may be formed by applying a first layer composed of flake glass reinforced plastic followed by a second layer of GRP composite which may include chopped strand. The glass flake reinforced plastic has good adhesion to the internal steel surface of the existing storage vessel. The chopped strand layer has good crack resistance.

Preferably, the first layer is less than about 5 mm thick, more preferably less than about 2 mm thick, an example of a suitable thickness of first layer would be about 0.5 mm.

Preferably, the second layer of GRP composite is less than about 10 mm thick, more preferably less than about 5 mm thick, an example of a suitable second layer thickness would be about 2 mm thick.

Preferably, the plastics material of the first skin may be impregnated with anti-corrosive agents. These help to prevent corrosion taking place between the intermediate layer and the surface of the steel tank. Localised corrosion of the steel at the interface between the steel and the plastic may produce sites of weakness.

Embodiments of the present invention will now be described, by way of example only, with reference to the accompanying drawings, in which.

Figure 5A:
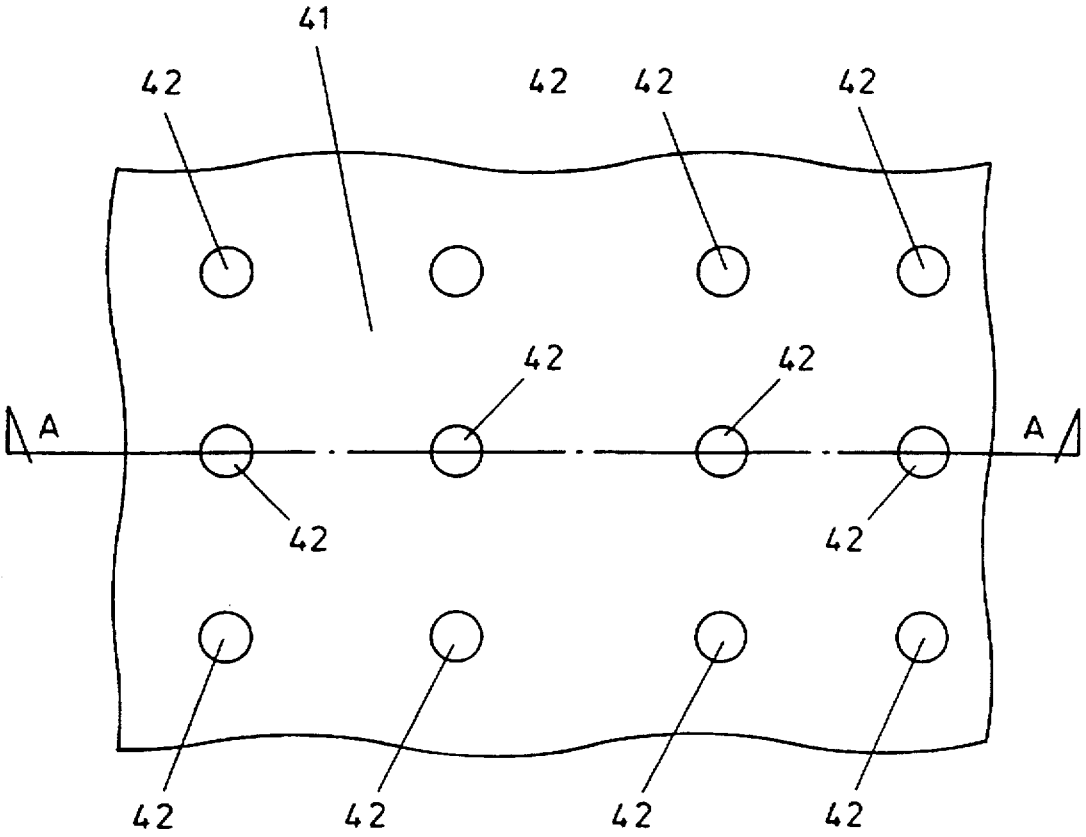
Figure 5B:
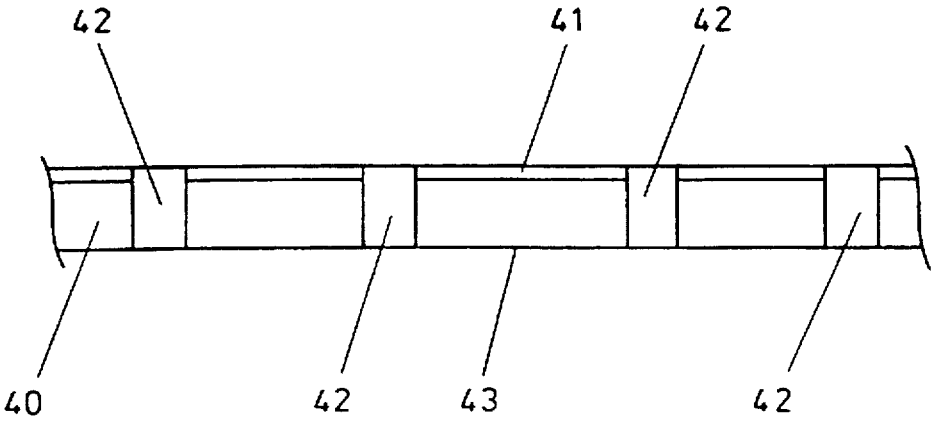
Figure 6:
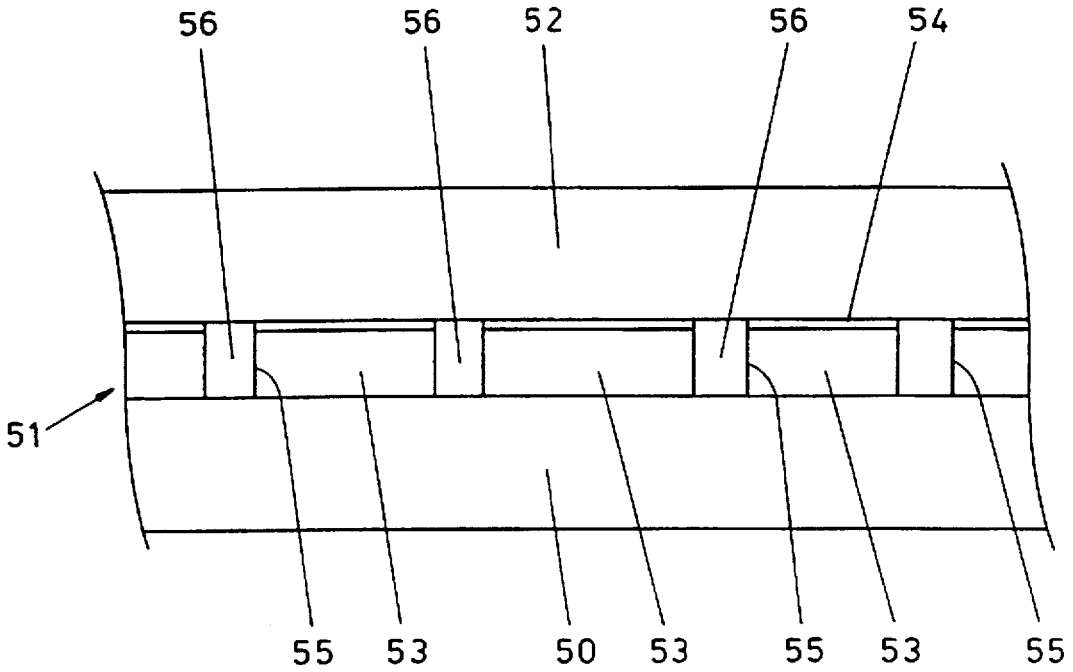
Figure 7:
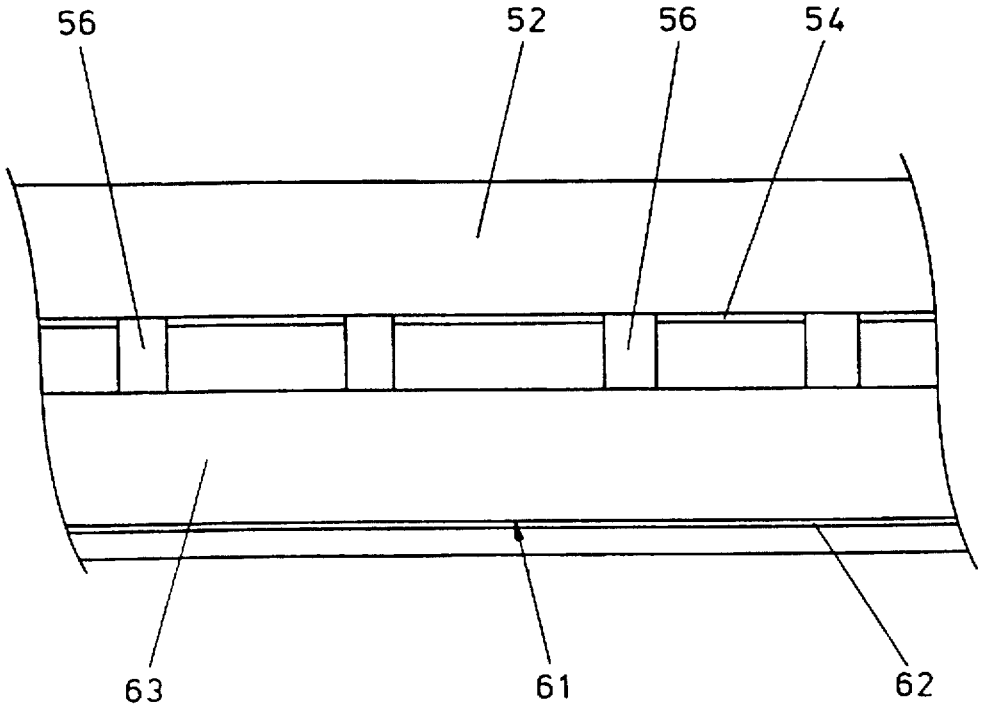
Figure 8:
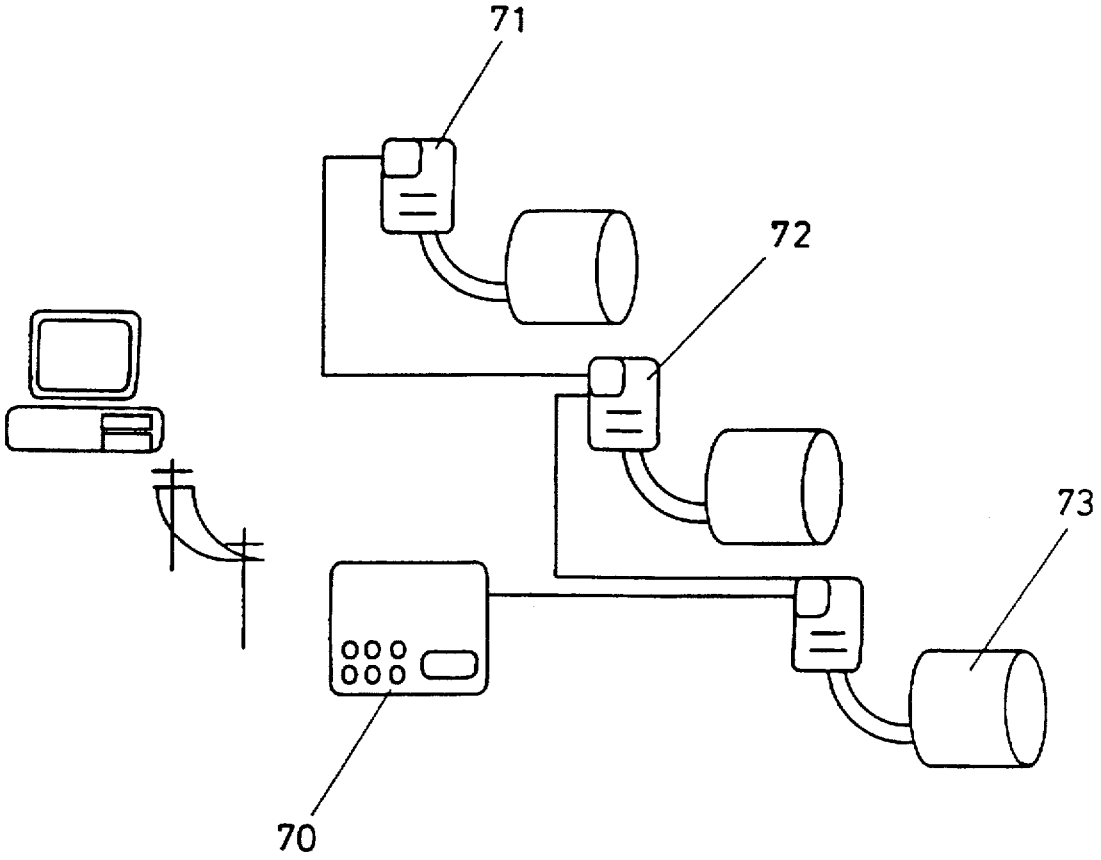

FIG. 5*a* is a plan view of a portion of membrane to form a liquid-pervious intermediate layer of the laminate;

FIG. 5*b* is a section taken on the line A—A in FIG. 5;

FIG. 6 is a cross-sectional view of a storage vessel using the membrane shown in FIG. 5;

FIG. 7 is a cross-sectional view of a refurbished storage vessel using the membrane shown in FIG. 5; and, FIG. 8 is a diagrammatic illustration of a leak detection system which may be used to monitor the sealing integrity of a storage vessel which has been refurbished by a method according to the invention.

Figure 1:
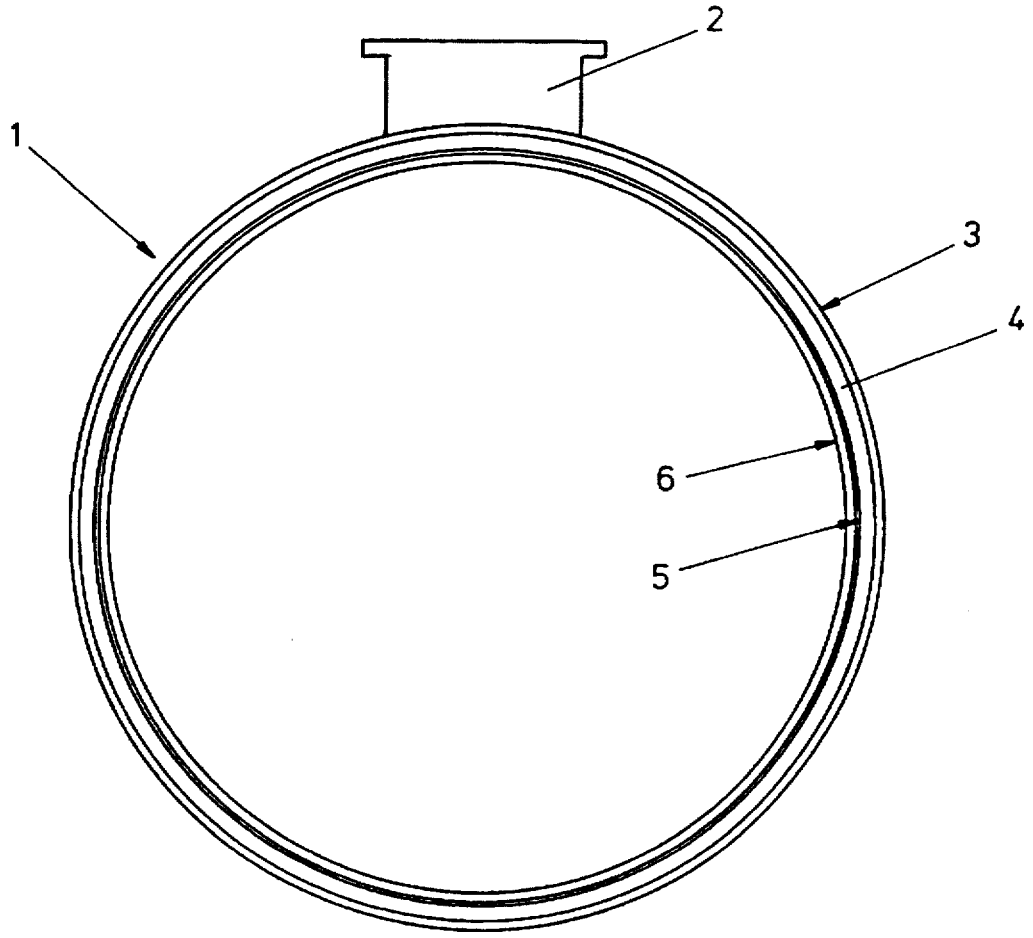
FIG. 1 is a cross-sectional view through a refurbished storage vessel in one embodiment of the invention.

Referring to the drawings FIG. 1 shows an underground storage vessel, generally indicated by reference numeral 1, of the type commonly used to store petroleum fuel at filling stations. The vessel 1 has a liquid-confining wall formed by a generally cylindrical and elongate body of steel with at least one opening 2 to permit the storage vessel to be replenished by, for example, a petrol tanker. The steel of these underground storage vessels is susceptible to corrosion. Pitting corrosion of the external surface 3 can lead to sites of weakness and may also be susceptible to stress corrosion cracking. The method of refurbishing an existing storage vessel which will be described produces a final product with enhanced mechanical properties and by means of an internally applied lamination.

Figure 2:
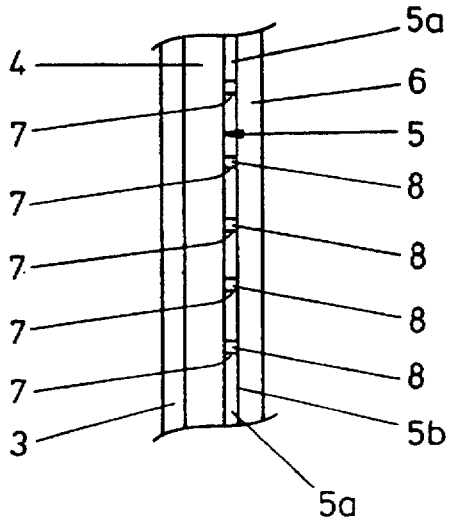
FIG. 2 is an enlarged view of a laminate construction applied to a wall of the refurbished storage vessel of FIG. 1.

A first skin 4 of reinforced plastic is formed on the internal surface of the storage vessel 1, which is composed of a layer of glass flake reinforced plastic applied directly to the internal surface of the storage vessel 1. This first layer may be about 0.5 mm thick and adheres well to the steel surface. A layer of composite glass reinforced plastic is then applied to the first layer to complete the first skin 4. The composite GRP may include chopped strand fibres. This layer, which may be between 2 mm and 3 mm thick enhances the strength and crack resistance of the layer. An intermediate layer comprising a permeable membrane 5 is then adhesively bonded to the layer 4. The membrane comprises a layer 5*a* of permeable material, for example, an open celled foam bonded to a semi-impermeable layer 5*b*, for example, paper. Although foam and paper are the preferred materials for the membrane, other permeable and semi-impermeable materials may be used effectively. Examples of suitable permeable materials include felt, screed and cloth. The membrane is approximately 3 mm thick. The membrane may also have a plurality of perforations 7 (see FIG. 2) extending therethrough. On application of an inner second skin 6, the GRP bonds with the first skin 4 via the perforations 7 to form bridges 8 between the inner skin 6 and the skin 4. These bridges enhance the strength and rigidity of the storage vessel. The resin present in the GRP of the inner skin 6 penetrates and impregnates the semi-impermeable layer 5*b* of the membrane 5. This provides an excellent bond to the membrane but also prevents resin from being absorbed by the highly absorbent layer 5*a* and blocking it. A monitoring fluid (liquid or gas) can be introduced into the permeable membrane 5 to monitor the sealing integrity of the vessel and provide warning of a leak. The quantity or level of the fluid in the membrane can be monitored by a gauge and the fluid may be pressurised so that even small cracks appearing in the structure of the vessel may be detected.

An alternative membrane could be formed by spraying solid adhesive coated spheres onto the first skin. The adhesive coating on the spheres ensures that the spheres adhere to the first skin and to each other. The inner skin of GRP is then applied on top of the spheres. The spaces at the interstices can accommodate a fluid so that the vessel can be monitored for leaks. A further alternative construction of membrane may be provided by spraying glass fibres or fibrils onto the first skin to form a porous layer or membrane.

Figure 3:
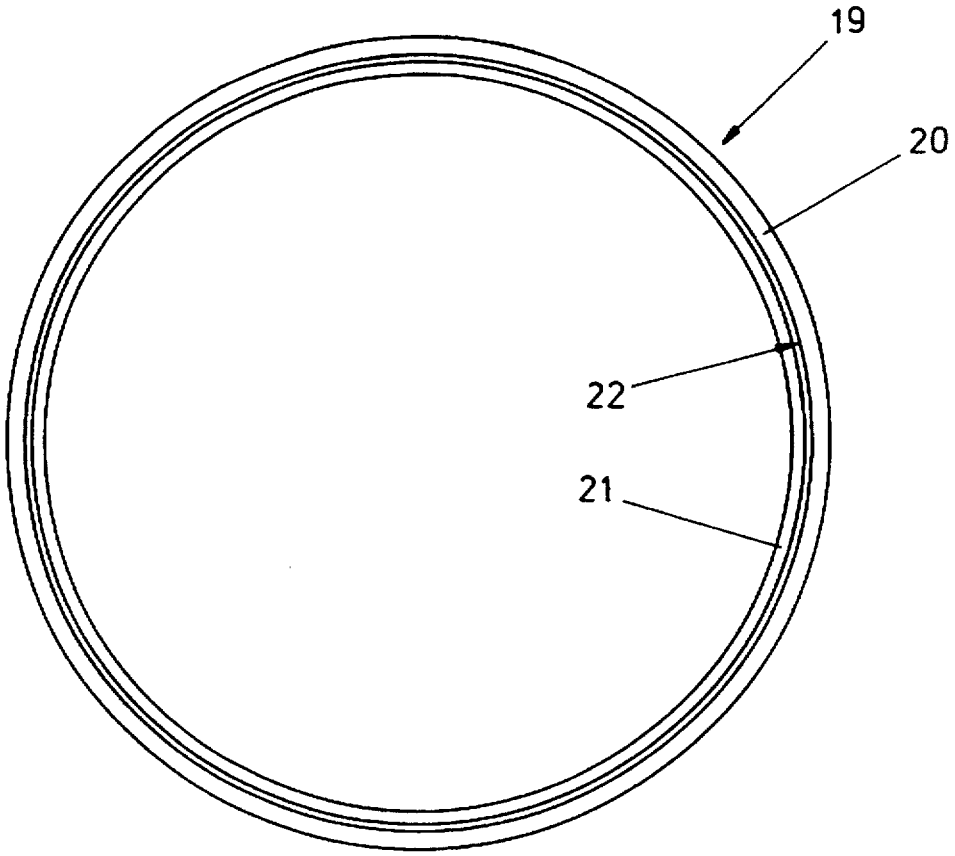
FIG. 3 is a cross-sectional view of a further embodiment of storage vessel according to the invention.
Figure 4:
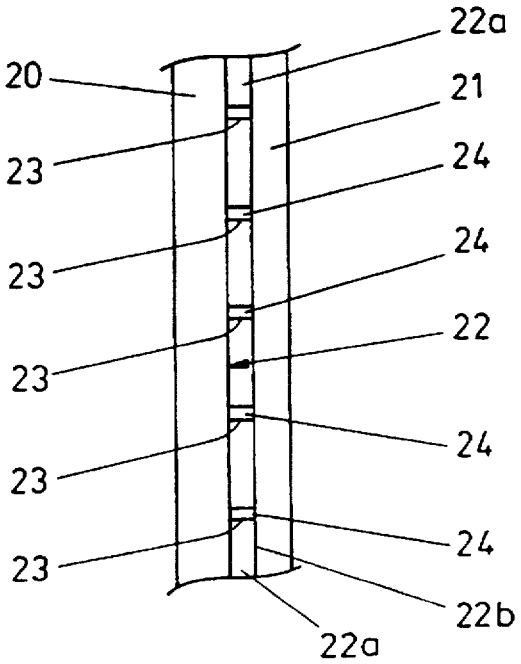
FIG. 4 is an enlarged cross-sectional view of the storage vessel shown in FIG. 3.

FIGS. 3 and 4 show an embodiment of storage vessel according to the invention, generally indicated by reference numeral 19, and which comprises an outer GRP skin 20 and an inner GRP skin 21 separated by a permeable membrane designated generally by reference 22 and comprising permeable layer 22*a* and semi-impermeable layer or skin 22*b*. In this storage vessel the GRP skins may be thicker as there is no steel structure to provide additional rigidity and strength. As described above, the membrane 22 has perforations 23 extending through the membrane so that GRP bridges 24 are formed to interconnect and join the inner and outer skins together. This construction of storage vessel is lighter, stronger and more rigid than existing double skinned storage vessel. Again alternative forms of membrane can be used and these have already been discussed above.

FIGS. 5*a* and 5*b* shows detail of a portion of permeable membrane which comprises a layer of permeable material 40, bonded to a semi-impermeable layer 41. Suitable permeable materials may include open celled foams, felts, screed or cloth. However, the preferred combination of materials is an open celled foam of approximately 2–3 mm thickness bonded to a layer of paper which is the semi-impermeable layer 41. The membrane is provided with a plurality of perforations 42 which permit GRP bridges to be formed between the first and second skins of the storage vessel (or between the intermediate and inner skins of a refurbished vessel). Distances between adjacent perforations is approximately 20 mm. The membrane is adhesively bonded to a skin of the vessel by its surface 43. The second or inner skin of GRP is applied to the paper layer of the membrane which absorbs some of the resin providing a good bond between the membrane and the GRP skin.

FIGS. 6 and 7 are cross-sectional views of the GRP skins in a storage vessel and a refurbished storage vessel respectively. FIG. 6 shows an outer skin 50 with a membrane 51 of open celled foam 53 adhesively bonded to the cured outer skin. An inner skin 52 of GRP has been applied to the semi-impermeable paper layer 54 of the membrane 51. On application of the inner GRP skin 52 to the membrane 51 resin from the inner skin impregnates and forms a bond with the paper layer 54. GRP also penetrates into the perforations 55 to form GRP bridges 56 enhancing the mechanical properties of the storage vessel. FIG. 7 shows the GRP layered construction applied to the internal surface 61 of an existing steel storage vessel. An initial layer 62 of glass flake reinforced plastic is applied to the steel. This is usually about 0.5 mm thick. A thicker layer 63 of composite GRP which may include chopped strand is applied to the layer 62. The chopped strand has a better crack resistance and strength than the layer 62, but the layer 62 provides a better bond to the steel.

Referring now to FIG. 8, this is a diagrammatic illustration of a leak detection system which may be used to monitor the sealing integrity of an underground storage vessel which has been refurbished by a method according to the invention. This system comprises a central monitoring unit 70, and isolator and power supply (not shown in detail), a local pressure measuring and alarm box 71, and a header tank 72 and ancillaries, all forming part of a pressurisation and leak detection system for monitoring the sealing integrity of petrol tank 73, which it is assumed has been refurbished by a method according to the invention, and in which it is desired to carry out a continuous monitoring of the sealing integrity of the tank by monitoring the presence and pressure of a monitoring fluid introduced into the liquid pervious monitoring space defined by the liquid pervious intermediate layer between the inner and outer plastics skins of the laminate applied to the wall of the tank. It should be understood that the pressurisation and leak detection system may be used either to monitor the integrity of a refurbished tank, or indeed also of a tank supplied as part of a new tank installation.

The header tank assembly provides a supply of monitoring fluid to the monitoring space of the tank 73, and desirably pressure is also put into the system to assist the monitoring process. Evidently, any loss in the sealing integrity of the tank e.g. liquid from externally of the tank passing inwardly through the wall of the tank, or internal liquid contents of the tank passing outwardly through the wall of the tank, will have an influence both on the amount and level of monitoring fluid in the monitoring space, and also its pressure, and the monitoring system can respond to one or both of these factors to provide a warning indication of any leak.

This system can be designed to be sufficiently sensitive to give early warning of a small leak developing, so that remedial action can be taken quickly.

Local area monitoring can be provided by means of monitoring gauges and alarms provided locally at the installation, and remote monitoring also can be provided for the system.

A compressor may be provided, as a part of the pressure and leak detection system, e.g. a 5 psi compressor, which applies pressure to the monitoring fluid within the monitoring space. This will usually be sufficient to maintain pressure in the system, and the system may be arranged to cause automatic re-pressurisation of the system when small pressure losses arise, and could be arranged only to raise an alarm if frequent re-pressurising is required, which would indicate a serious pressure loss situation and potential leakage problem. The automatic re-pressurising of the system, within set levels and frequencies, could be tolerated, and would save service call outs, or local staff having to pump up the system.

A float and magnet level detector may be constructed for the header tank, and with all of the wiring on the outside of the header tank.

The local pressure measuring and alarm box can be arranged to measure the pressure in the header tank and give indication of the following:

(a) an indication that the tank condition is satisfactory i.e. within safe set limits;

(b) give low level and low pressure indication;

(c) give high pressure indication if the tank has been over-pressurised.

The alarm box will communicate the pressure as well as any alarms over the LAN (local area network). If there has been a high pressure alarm, a warning indication will flash until such time as it is cleared (if appropriate) by monitoring staff.

The embodiments disclosed herein therefore comprise examples of method according to the invention, and storage vessels treated by the method, and which have the following general characteristics:

a first substantially impermeable layer 4 secured to one side of the wall of a storage vessel;

an intermediate liquid pervious layer 5 secured to the exposed side of the first layer 4;

a second substantially impermeable layer 6 secured to the exposed side of the intermediate layer 5 so as to define a fluid receiving space between the first and second layers 4, 6 in which a monitoring fluid can be received to permit monitoring of the sealing integrity of the storage vessel. The intermediate layer 5 includes a liquid or fluid pervious layer **5*a* e.g. of open celled foam, which is bonded to the first impermeable layer 4 and a semi-impermeable layer 5*b* e.g. of paper which faces and which becomes bonded to the second impermeable layer 6 upon at least partial impregnation by the material of the layer 6. The layer 5*b*, therefore performs a dual function, in that it assists in uniting the component layers of the laminate, and also prevents the material making-up the second impermeable layer 6 from impregnating or clogging-up the pores of the pervious layer 5*a***.

I claim:

1. A storage vessel (1) for containing a fluid, in which a wall of the vessel has a laminate secured to one side thereof, and said laminate comprising:

a first impermeable layer (4) secured to said one side of the wall;

a second impermeable layer (6); and, an intermediate liquid pervious layer (5) secured on one side to said first layer (4) and secured on an opposite side to said second layer (6), said intermediate layer (5) comprising a fluid pervious layer (**5*a*) secured to said first impermeable layer (4), and a semi-impermeable layer (5*b*) on one side facing and bonded to said second impermeable layer (6**).

2. A storage vessel according to claim 1, in which the fluid pervious layer (5*a*) comprises open celled foam.

3. A storage vessel according to claim 1 or claim 2, in which the semi-impermeable layer (5*b*) comprises a paper layer bonded to said fluid pervious layer (5*a*), prior to application of said intermediate liquid pervious layer (5) to said one side of said first layer (4).

4. A storage vessel according to claim 3, in which the semi-impermeable layer (5*b*) has perforations (7) formed therein, prior to application of said intermediate liquid pervious layer (5), said perforations allowing bridges of material forming said second layer (6) to pass through the perforations (7) during the moulding of the second layer (6) to the semi-impermeable layer (5*b*).

5. A storage vessel according to claim 4, in which the laminate (4, 5, 6) is secured to a metal wall of a storage tank.

6. A storage vessel according to claim 4, in which the laminate (4, 5, 6) is secured to a wall made of moulded plastics material.

7. A storage vessel according to claim 4, in which the second impermeable layer (6) is made of plastics material which is moulded to one side of said liquid pervious intermediate layer (5), and which is also adhesively secured to the first impermeable layer (4) via connecting bridges of plastics material (8) which extend through the liquid pervious intermediate layer (5).

8. A storage vessel according to claim 7, in which a monitoring system is arranged to monitor the presence of a monitoring fluid in the fluid receiving space defined by the intermediate liquid pervious layer (5) between the first and second layers (4, 6) to monitor the sealing integrity of the storage vessel.

9. A method of making the storage vessel of claim 1 which comprises:

securing a first impermeable layer (4) to one side of a wall of a storage vessel;

securing an intermediate liquid pervious layer (5) to the exposed side of said first layer (4); and securing a second impermeable layer (6) to the exposed side of the intermediate layer (5) so as to define a fluid receiving space between the first and second layers (4, 6).

10. A method according to claim 9, in which the liquid pervious intermediate layer (5) comprises a layer (5*a*) of open celled foam having a semi-impermeable layer (5*b*) on one side facing the second impermeable layer (6), and in which the semi-impermeable layer (5*b*) becomes bonded to the second impermeable layer (6) upon application of the latter, whereby the semi-impermeable layer (5*b*) serves both to join the second impermeable layer (6) to the laminate by at least partial permeation of the layer (5*b*), and also serving to at least form a partial barrier to permeation of the permeable layer (5*a*) of the intermediate layer.

11. A method according to claim 9 or 10, in which the semi-impermeable layer (5*b*) has perforations (7) which allow bridges (8) of the material forming the second layer (6) to pass through the perforations (7) during moulding of the second layer (6) to the semi-impermeable layer (5*b*).

12. A method according to claim 11, in which the second impermeable layer (6) is made of plastics material which is moulded to one side of the liquid pervious intermediate layer (5), and is also secured to the first impermeable layer (4) via connecting bridges of plastics material (8) which extend through the liquid pervious intermediate layer (5).

13. A method according to claim 12, in which the first impermeable layer (4) comprises a layer of glass flake reinforced plastics applied directly to a surface of the wall of the vessel.

14. A method according to claim 13, in which the first impermeable layer (4) also includes a further layer of composite glass reinforced plastics applied subsequently to the glass flake reinforced plastics which has been applied to the surface of said wall.

15. A method according to claim 14, in which the laminate is applied to the internal surface of the wall of an underground storage vessel.

* * * * *